US012290172B2

(12) United States Patent
Lin

(10) Patent No.: US 12,290,172 B2
(45) Date of Patent: May 6, 2025

(54) ELECTRIC DESK FRAME STRUCTURE

(71) Applicant: TIMOTION TECHNOLOGY CO., LTD., New Taipei (TW)

(72) Inventor: Yu-Chang Lin, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 188 days.

(21) Appl. No.: 18/223,545

(22) Filed: Jul. 19, 2023

(65) Prior Publication Data

US 2024/0358148 A1 Oct. 31, 2024

(30) Foreign Application Priority Data

Apr. 27, 2023 (TW) ..... 112204030

(51) Int. Cl.
*A47B 9/04* (2006.01)

(52) U.S. Cl.
CPC ..... *A47B 9/04* (2013.01); *A47B 2200/008* (2013.01)

(58) Field of Classification Search
CPC ..... A47B 9/00; A47B 9/04; A47B 2009/043; A47B 2200/008
USPC ..... 108/144.11
See application file for complete search history.

(56) References Cited

U.S. PATENT DOCUMENTS 4,593,874 A * 6/1986 Dunagan ..... A47B 9/04 248/188.4
5,088,421 A * 2/1992 Beckstead ..... A47B 9/12 248/406.1
5,259,326 A * 11/1993 Borgman ..... A47B 9/00 108/147
6,352,037 B1 * 3/2002 Doyle ..... A47B 9/00 108/50.02
6,595,144 B1 * 7/2003 Doyle ..... A47B 9/00 248/188.4
7,246,779 B2 * 7/2007 Doyle ..... A47B 9/10 248/188.8
7,806,384 B2 * 10/2010 Doyle ..... B66F 1/08 108/50.02
7,862,409 B1 * 1/2011 Sheppard ..... A47B 9/04 452/198
9,655,445 B2 * 5/2017 Gammon ..... A47B 87/005
(Continued)

FOREIGN PATENT DOCUMENTS

CN 215817533 U 2/2022

*Primary Examiner* — Daniel J Troy
*Assistant Examiner* — Timothy M Ayres
(74) *Attorney, Agent, or Firm* — Chun-Ming Shih; HDLS IPR SERVICES

(57) ABSTRACT

A an electric deck frame structure (1, 1A) includes: corner lifting vertical posts (10), each having a carrying seat (11) and a retractable rod (12), the carrying seat includes a first connection part (111) having a first electric connection assembly (1133) and a second connection part (116) having a second electric connection assembly (1183); connection pipes (20), connected to the corner lifting vertical posts (10) and having a first opening (21) and a second opening (22); a transformer (30) having an electricity input port (31) arranged corresponding to the first opening (21) and an electricity output port (32) arranged corresponding to the second opening (22), the transformer is hidden in the connection pipe, and a power and signal main cable (40), connected to the electricity output port (32), the first electric connection assembly (1133) and the second electric connection assembly (1183).

13 Claims, 11 Drawing Sheets

(56) References Cited

U.S. PATENT DOCUMENTS

| | | | | |
|---|---|---|---|---|
| 9,703,278 | B2 * | 7/2017 | Kristensen | G05B 15/02 |
| 9,723,916 | B2 * | 8/2017 | Chen | A47B 9/04 |
| 9,848,696 | B2 * | 12/2017 | Tseng | A47B 9/04 |
| 10,758,039 | B2 * | 9/2020 | Allen | F16H 25/20 |
| 10,782,824 | B2 * | 9/2020 | Nagano | G06F 3/0416 |
| 10,869,547 | B2 * | 12/2020 | Lu | A47B 9/00 |
| 11,089,864 | B2 * | 8/2021 | Davidsen | A47B 1/08 |
| 11,096,481 | B2 * | 8/2021 | Patton | A47B 13/023 |
| 11,696,637 | B2 * | 7/2023 | Lin | A47B 9/04 108/144.11 |
| 12,022,940 | B2 * | 7/2024 | Weidmann | A47B 21/02 |
| 2005/0274303 | A1 * | 12/2005 | Scherrer | A47B 9/04 108/155 |
| 2019/0059572 | A1 * | 2/2019 | Moody | B23K 37/0461 |
| 2020/0046113 | A1 * | 2/2020 | Nourse | A47B 21/02 |
| 2021/0215236 | A1 | 7/2021 | Lukas | |
| 2022/0378194 | A1 * | 12/2022 | Lin | A47B 21/06 |
| 2022/0400846 | A1 * | 12/2022 | Lin | A47B 9/04 |
| 2023/0131791 | A1 * | 4/2023 | Weidmann | A47B 21/02 108/144.11 |

* cited by examiner

ELECTRIC DESK FRAME STRUCTURE

BACKGROUND OF THE DISCLOSURE

Technical Field

The present disclosure relates to a desk frame, especially to an electric desk frame structure.

Description of Related Art

For satisfying different body types, heights and user habits, a related-art desk with a fixed size has been gradually replaced by the user. As such, an electric lifting desk having the heights thereof being adjustable has become the main designing trend. After the height being adjusted, the desk may match the different body types and heights of the user to make the user has a most comfortable using experience.

The related-art electric lifting desk mainly includes an electric foot frame and a desk plate disposed on the top end of the electric foot frame. The electric foot frame mainly includes a carrying frame body, a plurality of retractable foots connected to the carrying frame body and a control system electrically connected to each of the retractable foots to control each of the retractable foots to be ascended and descended. The control system mainly includes a case member, a transformer and a central controller unit. Wherein, the transformer and the central controller unit are disposed in the case member, and electrically connected to a motor of the retractable foot via a plurality of conductive wires. Because the control systems required by the electric lifting desk is designed corresponding to the amounts of the foots, when the amounts of the foots are desired to be increased or decreased, a matched control system is required to be designed and fabricated again. As such, unnecessary time is wasted and no economic effect is provided. Moreover, when each conductive flat cable is collected and connected to the central controller unit, a situation of poor arrangement of the cables under the desk table is caused.

Accordingly, the applicant of the present disclosure has devoted himself for improving the mentioned shortages.

SUMMARY OF THE DISCLOSURE

The present disclosure is to provide an electric desk frame structure, in which the amounts of lifting vertical posts may be increased according to actual needs to provide an electric deck frame with a different configuration.

Accordingly, the present disclosure provides an electric deck frame structure, which includes at least four corner lifting vertical posts, at least four connection pipes, a transformer and a power and signal main cable. Each two of the corner lifting vertical posts are oppositely and spacedly arranged. Each of the corner lifting vertical posts includes a carrying seat and a retractable rod connected to the carrying seat. The carrying seat includes a first connection part and a second connection part. The first connection part is disposed with a first electric connection assembly. The second connection part is disposed with a second electric connection assembly electrically connected to the first electric connection assembly. Each of the connection pipes is connected to each of the corner lifting vertical posts. Two ends of each of the connection pipes are connected to the first connection part of one of the carrying seats and the second connection part of the another carrying seat adjacent to the carrying seat. One of the connection pipes is formed with a first opening and a second opening. The transformer has an electricity input port and an electricity output port. The transformer is hidden in the connection pipe having the first opening and the second opening. The electricity input port is arranged corresponding to the first opening. The electricity output port is arranged corresponding to the second opening. The power and signal main cable is connected to the electricity output port, each of the first electric connection assemblies and each of the second electric connection assemblies.

Advantages achieved by the present disclosure are as follows. The power and signal power main cable communicates the information of each of the lifting vertical posts to be adjusted, thus a case member is not required to be additionally disposed on the desk frame structure of the present disclosure. The amounts of the lifting vertical posts may be adjusted to make the present disclosure be applicable in different environments. Moreover, with the arrangement of each cable accommodating recess and each bypass recess, a plug and a cable body of each power and signal cable may be hidden therein, thus no cable and relevant components are seen when a desk plate covers on the electric desk frame structure. As such, the whole structure of the present disclosure is provided with an advantage of tidy and better appearance.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION OF THE DISCLOSURE

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
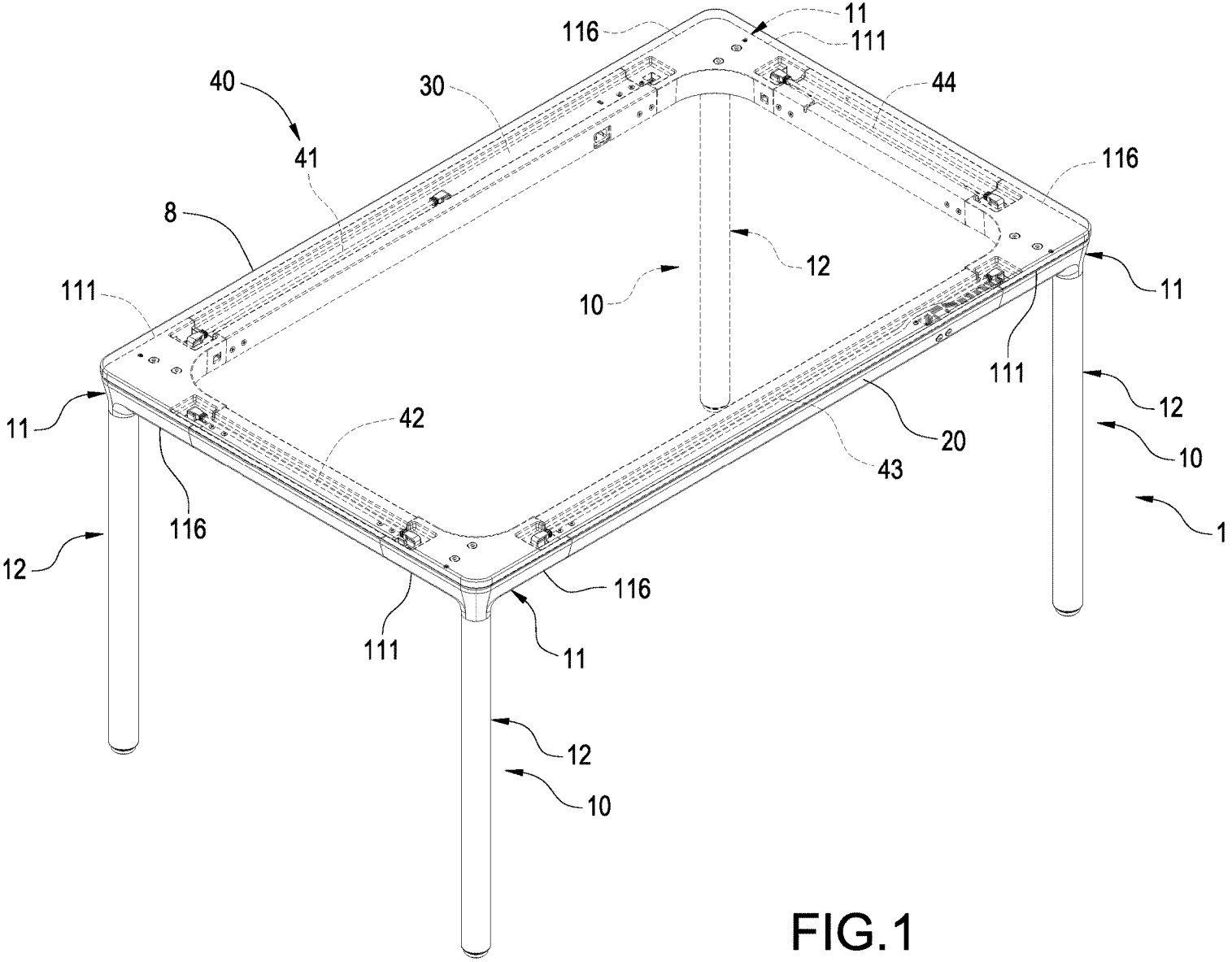
FIG. 1 is a perspective view showing the assembly of the electric desk frame structure being combined with a desk plate according to the present disclosure.
Figure 2:
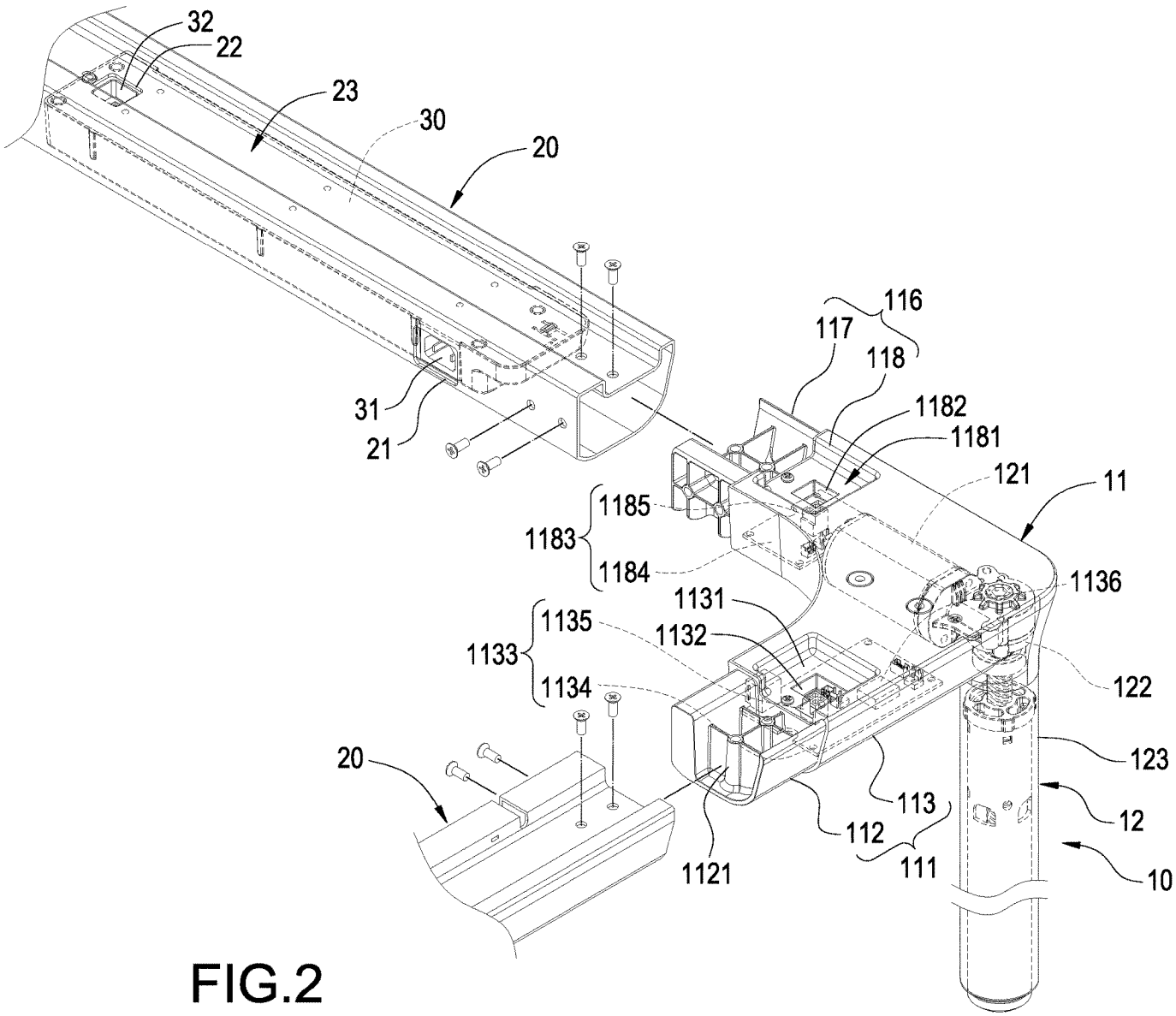
FIG. 2 is an exploded view showing the corner lifting vertical post being connected to each of the connection pipes according to the present disclosure.
Figure 3:
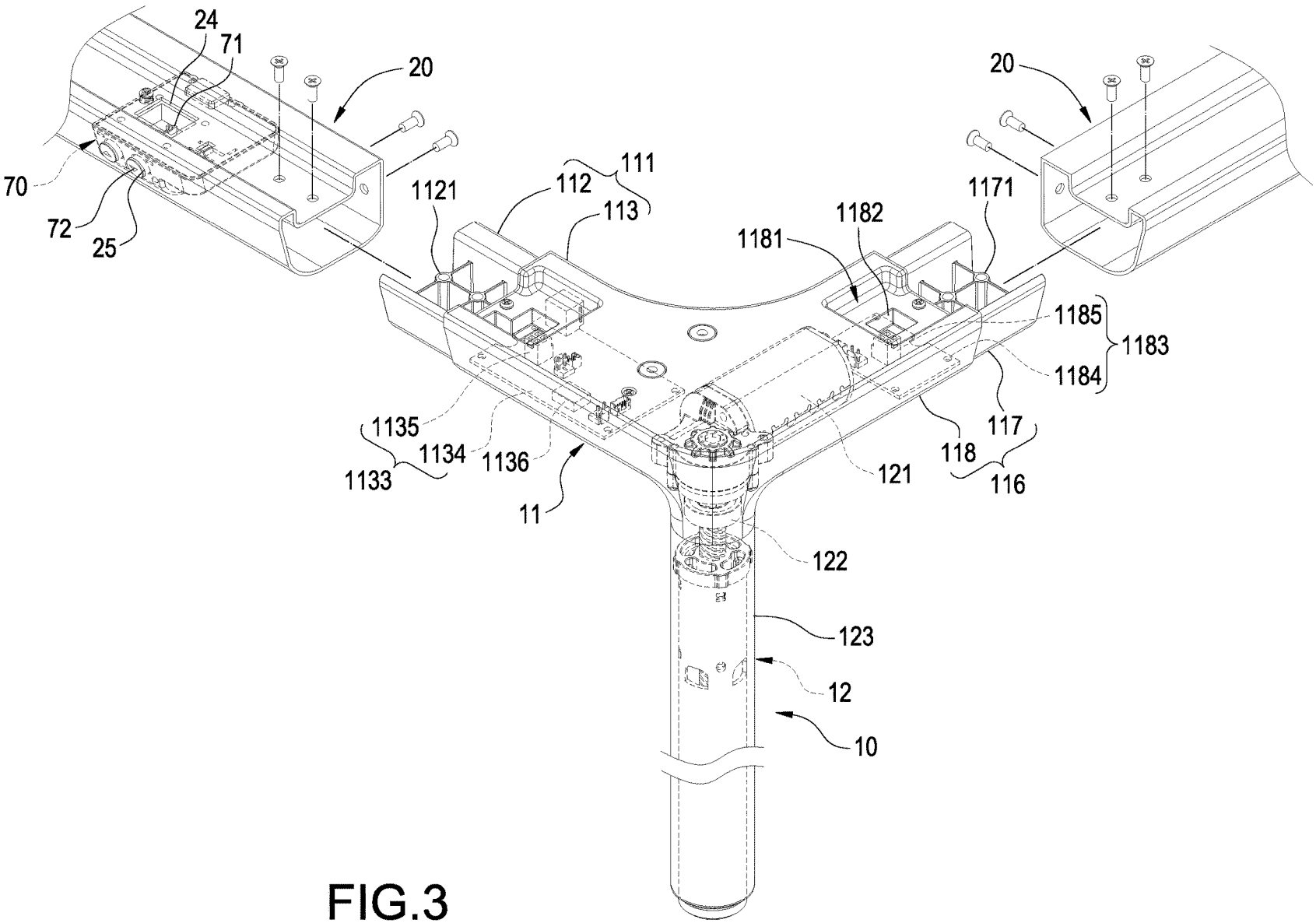
FIG. 3 is an exploded view showing another corner lifting vertical post being connected to each of the connection pipes according to the present disclosure.

Please refer from FIG. 1 to FIG. 3, the present disclosure provides an electric desk frame structure 1, which is used to allow a desk plate 8 to be placed. In some embodiments, the electric desk frame structure 1 mainly includes four corner lifting vertical posts 10, four connection pipes 20, a transformer 30 and a power and signal main cable 40.

The four corner lifting vertical posts 10 are oppositely and spacedly arranged. Each of the corner lifting vertical posts 10 mainly includes a carrying seat 11 and a retractable rod 12. The carrying seat 11 is formed in a substantial L shape, and a first connection part 111 and a second connection part 116 are formed at two arm members thereof. The first connection part 111 mainly includes a mounting segment 112 and a stopping segment 113 connected to the mounting segment 112. A plurality of studs 1121 are disposed at a top side and an inner side of the mounting segment 112. A bypass recess 1131 is disposed in the stopping segment 113, and a penetrated hole 1132 is formed at a central location of the bypass recess 1131. A first electric connection assembly 1133 is disposed in the stopping segment 113. The first electric connection assembly 1133 mainly includes a circuit board 1134 and a socket 1135 fastened on and electrically connected to the circuit board 1134. The socket 1135 is arranged corresponding to the penetrated hole 1132.

The second connection part 116 mainly includes a mounting segment 117 and a stopping segment 118 connected to the mounting segment 117. A plurality of studs 1171 are disposed at a top side and an inner side of the mounting segment 117. A bypass recess 1181 is disposed in the stopping segment 118, and a penetrated hole 1182 is formed at a central location of the bypass recess 1181. A second electric connection assembly 1183 is disposed in the stopping segment 118. The second electric connection assembly 1183 mainly includes a circuit board 1184 and a socket 1185 fastened on and electrically connected to the circuit board 1184. The socket 1185 is arranged corresponding to the penetrated hole 1182.

The retractable rod 12 is disposed at a bottom end of the carrying seat 11, and mainly includes a motor 121, a transmission mechanism 122 and a plurality of rod members 123. The first electric connection assembly 1133 is electrically connected to the second electric connection assembly 1183 via a flat cable (not shown in figures), and electrically connected to the motor 121. Each of the rod members 123 is connected to the transmission mechanism 122. The transmission mechanism 122 is connected to the motor 121 and driven by the motor 121, thus the transmission mechanism 122 is driven by the motor 121 to be operated to make each of the rod members 123 be ascended or descended.

The circuit board 1134 of the first electric connection assembly 1133 is disposed with a control unit 1136 having a micro controller unit (MCU). The control unit 1136 receives a control signal to control the operation of the motor 121 to drive each of the rod members 123 to be retractably moved. Moreover, the control unit 1136 may be disposed on the circuit board 1184 of the second electric connection assembly 1183.

Each of the connection pipes 20 is connected to each of the corner lifting vertical posts 10. Two ends of each of the connection pipes 20 is connected to the first connection part 111 of one of the carrying seats 11 and the section connection part 116 of the another carrying seat 11 adjacent to the above-mentioned carrying seat 11. One of the connection pipes 20 is formed with a first opening 21 and a second opening 22. A top end of each of the connection pipes 20 is axially formed with a cable accommodating recess 23.

The transformer 30 has an electricity input port 31 and an electricity output port 32. The transformer 30 is hidden in the connection pipe 20 having the first opening 21 and the second opening 22. The electricity input port 31 is arranged corresponding to the first opening 21 to allow a public power to be inserted. The electricity output port 32 is arranged corresponding to the second opening 22.

The power and signal main cable 40 is hidden in the cable accommodating recess 23 of each of the connection pipes 20. In some embodiments, the power and signal main cable 40 mainly includes a first power and signal cable 41, a second power and signal cable 42, a third power and signal cable 43 and a fourth power and signal cable 44. Two ends of the first power and signal cable 41 are connected to the electricity output port 32 and the first electric connection assembly 1133 of the corner lifting vertical post 10. Two ends of the second power and signal cable 42 are connected to the second electric connection assembly 1183 of the corner lifting vertical post 10 and the first electric connection assembly 1133 of the another corner lifting vertical post 10. Two ends of the third power and signal cable 43 are connected to the second electric connection assembly 1183 of the another corner lifting vertical post 10 and the first electric connection assembly 1133 of the one another corner lifting vertical post 10. Two ends of the fourth power and signal cable 44 are connected to the second electric connection assembly 1183 of the one another corner lifting vertical post 10 and the first electric connection assembly 1133 of the other corner lifting vertical post 10.

Please refer from FIG. 4 to FIG. 10. In some embodiments, an electric desk frame structure 1A mainly includes four corner lifting vertical posts 10, six connection pipes 20, a transformer 30, a power and signal main cable 40, two middle lifting vertical posts 50 and a middle connection member 60.

The structural characteristics and the connection relation of each of the corner lifting vertical posts 10, each of the connection pipes 20, the transformer 30 and the power and signal main cable 40 are substantially the same as the above-mentioned arrangement. The difference is that the first connection part 111 of one of the carrying seats 1 is formed with an insertion slot 114 used to allow a wireless receiver 115 to be inserted, thus a user may control the ascending and descending motion of each of the corner lifting vertical posts 10 via a wireless controlling manner.

In some embodiments, the first connection part 111 of one of the carrying seats 11 is disposed with the insertion slot 114. With respect to actual needs, the first connection part 111 of each of the carrying seats 11 is disposed with the insertion slot 114, thus the wireless receiver 115 is freely inserted in one of the insertion slots 114, and the ascending and descending motion of each of the corner lifting vertical posts 10 is controlled via a wireless manner.

Figure 5:
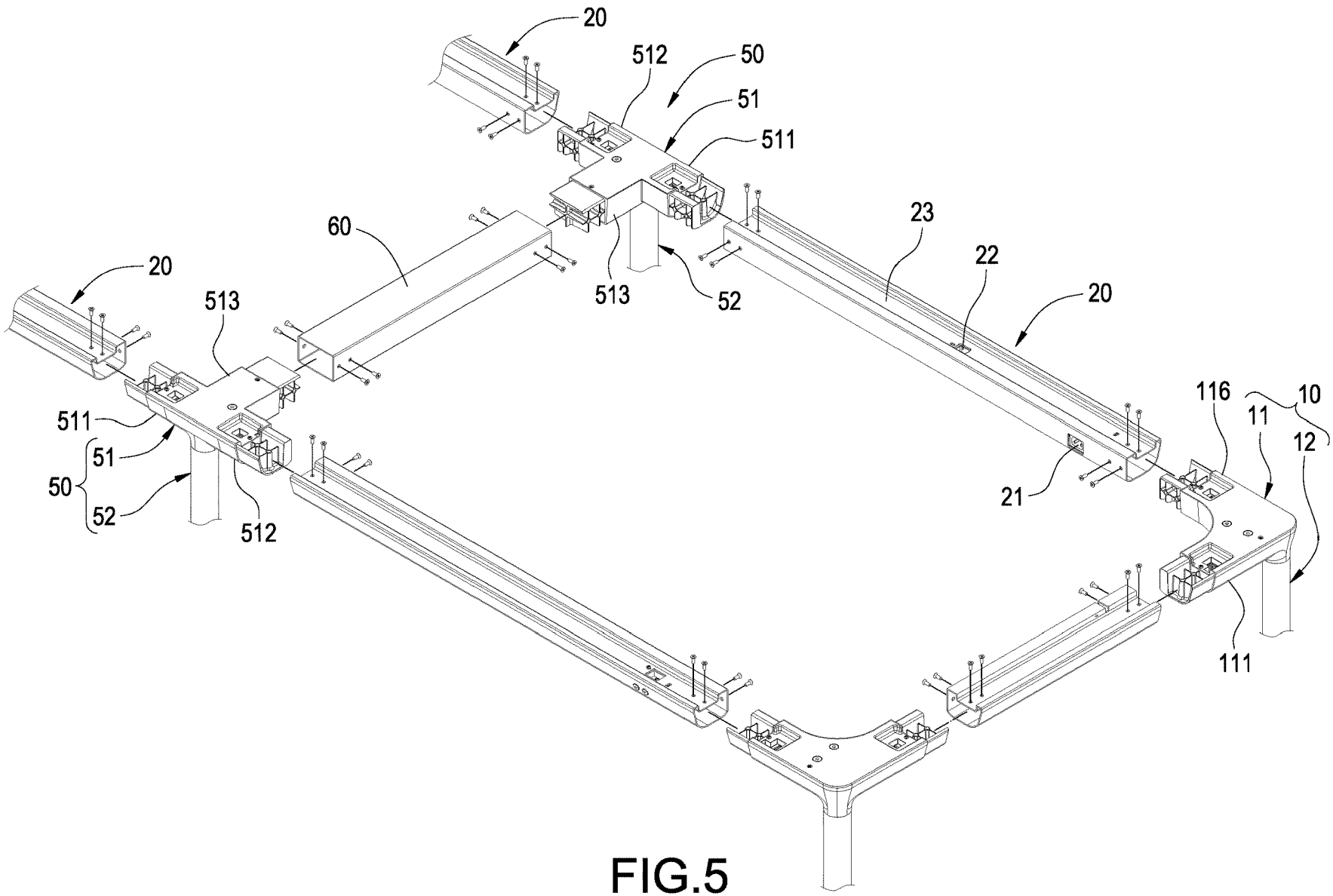
FIG. 5 is an exploded view according to another embodiment of the present disclosure.
Figure 6:
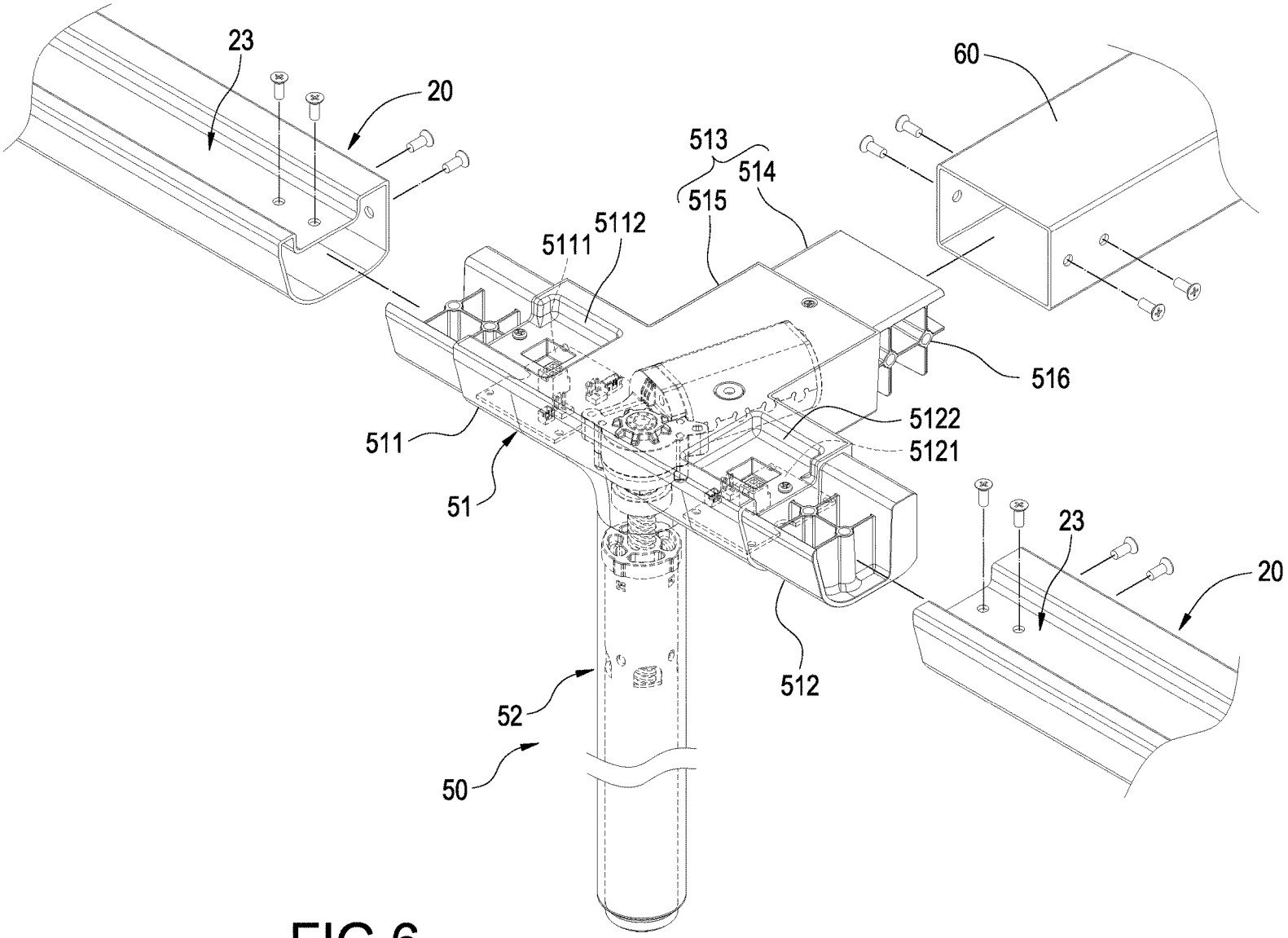
FIG. 6 is an exploded view showing the middle lifting vertical post, each of the connection pipes and the middle connection member according to the present disclosure.

Please refer to FIG. 5 and FIG. 6, each of the middle lifting vertical posts 50 is correspondingly disposed between two of the corner lifting vertical posts 10 and spacedly arranged, thus an upper portion of the electric desk frame structure 1A is formed as a rectangular frame. Each of the middle lifting vertical posts 50 mainly includes a carrying seat 51 and a retractable rod 52. The retractable rod 52 is the same as the retractable rod 12 of the corner lifting vertical post 10. The carrying seat 51 is formed in an Tshape, and has a first connection part 511, a second connection part 512 and a third connection part 513. The third connection part 513 is arranged perpendicular to the first connection part 511 and the second connection part 512. The first connection part 511 is the same as the first connection part 111 of the corner lifting vertical post 10, and also disposed with a first electric connection assembly 5111. The second connection part 512 is the same as the second connection part 116 of the corner lifting vertical post 10, and also disposed with a second electric connection assembly 5121. The second electric connection assembly 5121 is electrically connected to the first electric connection assembly 5111. The third connection part 513 mainly includes a mounting segment 514 and a stopping segment 515 connected to the mounting segment 514. A plurality of studs 516 are disposed at a left side and a right side of the mounting segment 514.

In some embodiments, there are six connection pipes 20, two ends of two of the connection pipes 20 are connected to the second connection part 116 of the corner lifting vertical post 10 and the first connection part 511 of the middle lifting vertical post 50. Two ends of the another two of the connection pipes 20 are connected to the second connection part 512 of the middle lifting vertical post 50 and the first connection part 111 of the corner lifting vertical post 10. Two ends of the rest two connection pipes 20 are connected to the first connection part 111 of the corner lifting vertical post 10 and the second connection part 116 of the adjacent corner lifting vertical post 10.

Two ends of the middle connection member 60 sheath the mounting segment 514 of the third connection part 513 of each of the middle lifting vertical posts 50, and locking members such as screw bolts are used to pass each of the studs 516 to be locked.

Figure 7:
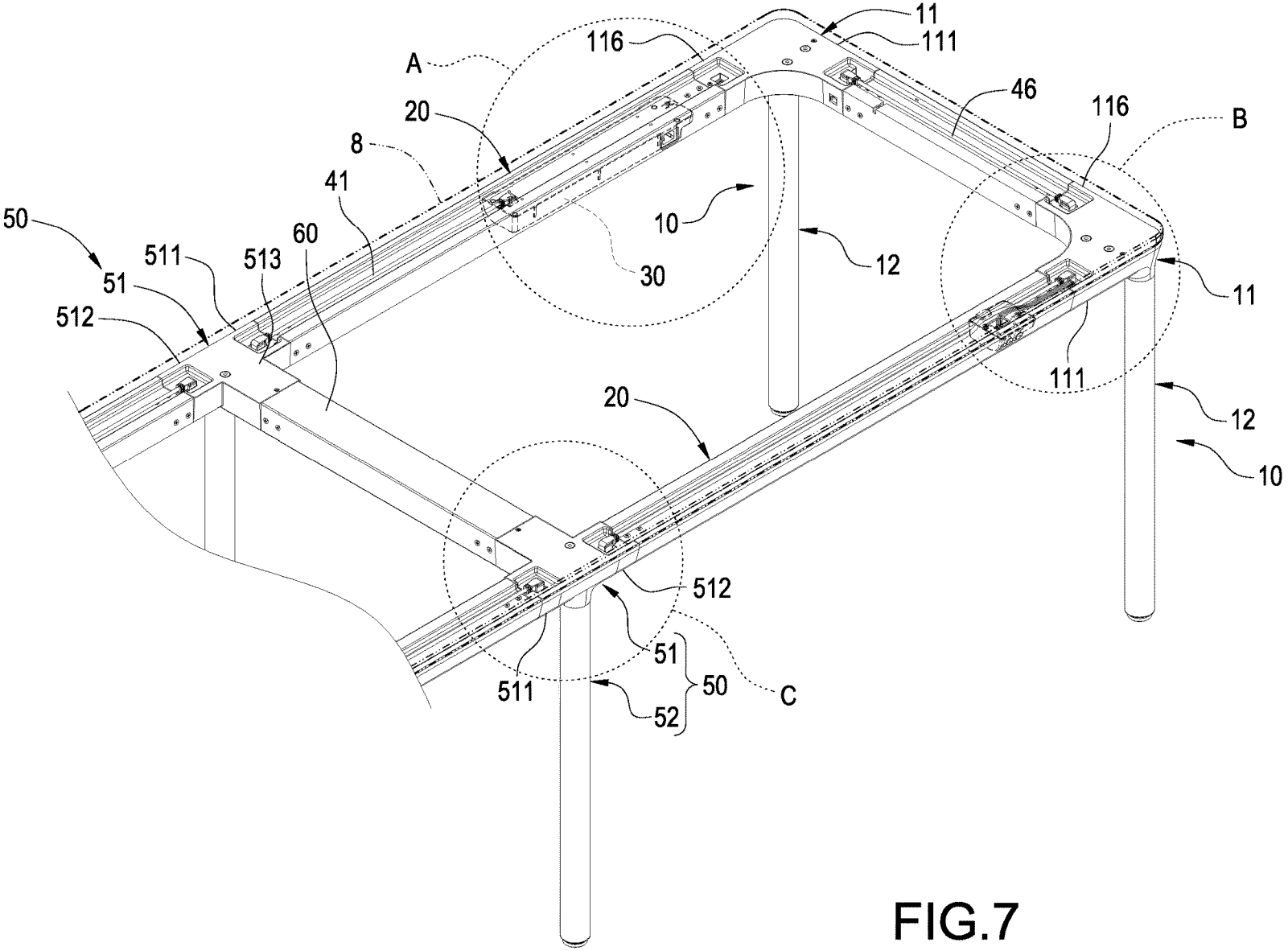
FIG. 7 is a schematic view showing a partial assembly according to another embodiment of the present disclosure.
Figure 8:
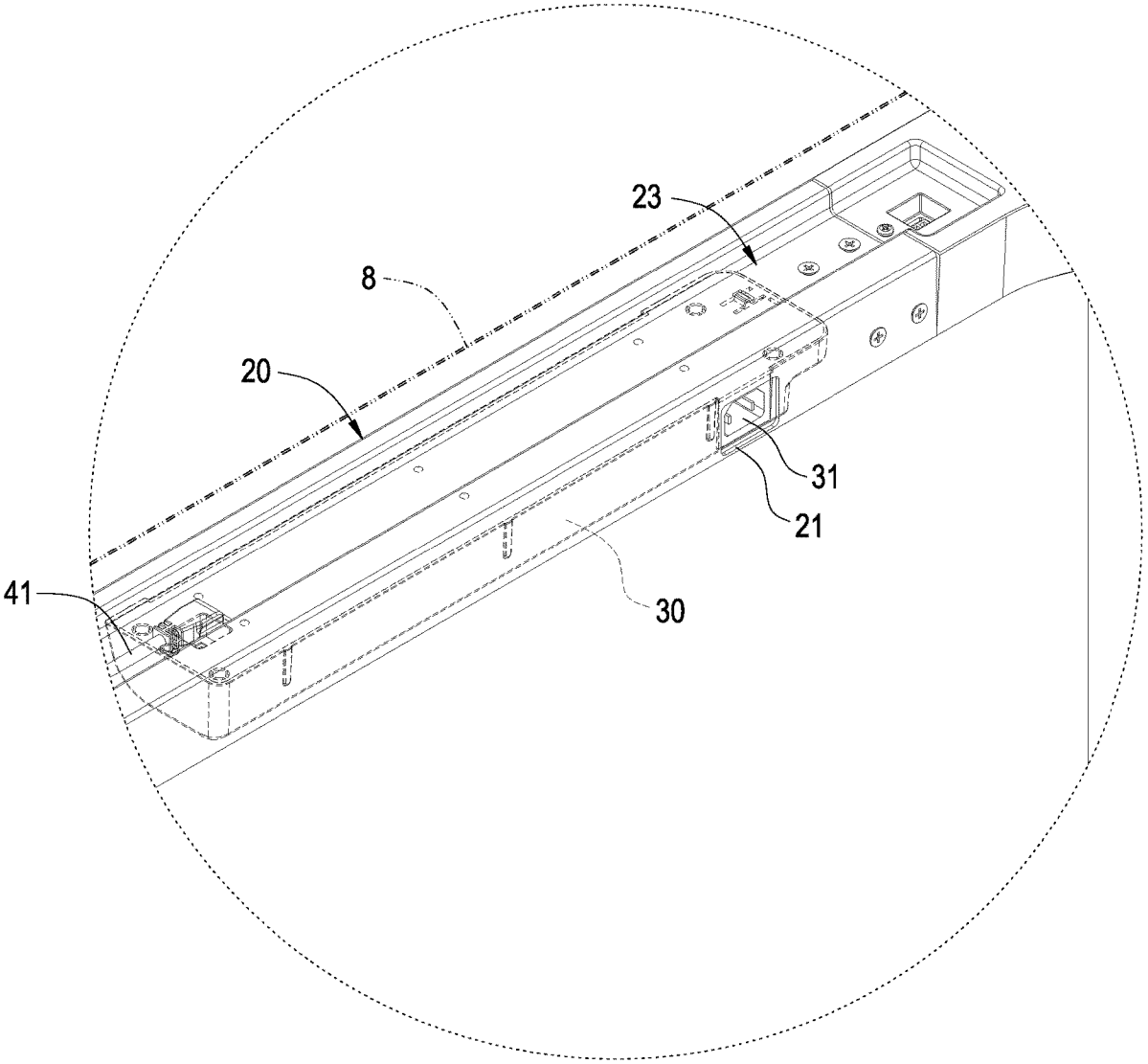
FIG. 8 is a partially enlarged view of zone A of FIG. 7.

Please refer to FIG. 7 and FIG. 8, the transformer 30 has an electricity input port 31 and an electricity output port 32. The transformer 30 is hidden in the connection pipe 20 having the first opening 21 and the second opening 22. The electricity input port 31 is arranged corresponding to the first opening 21 to allow a public power to be inserted. The second electricity output port 32 is arranged corresponding to the second opening 22.

Figure 4:
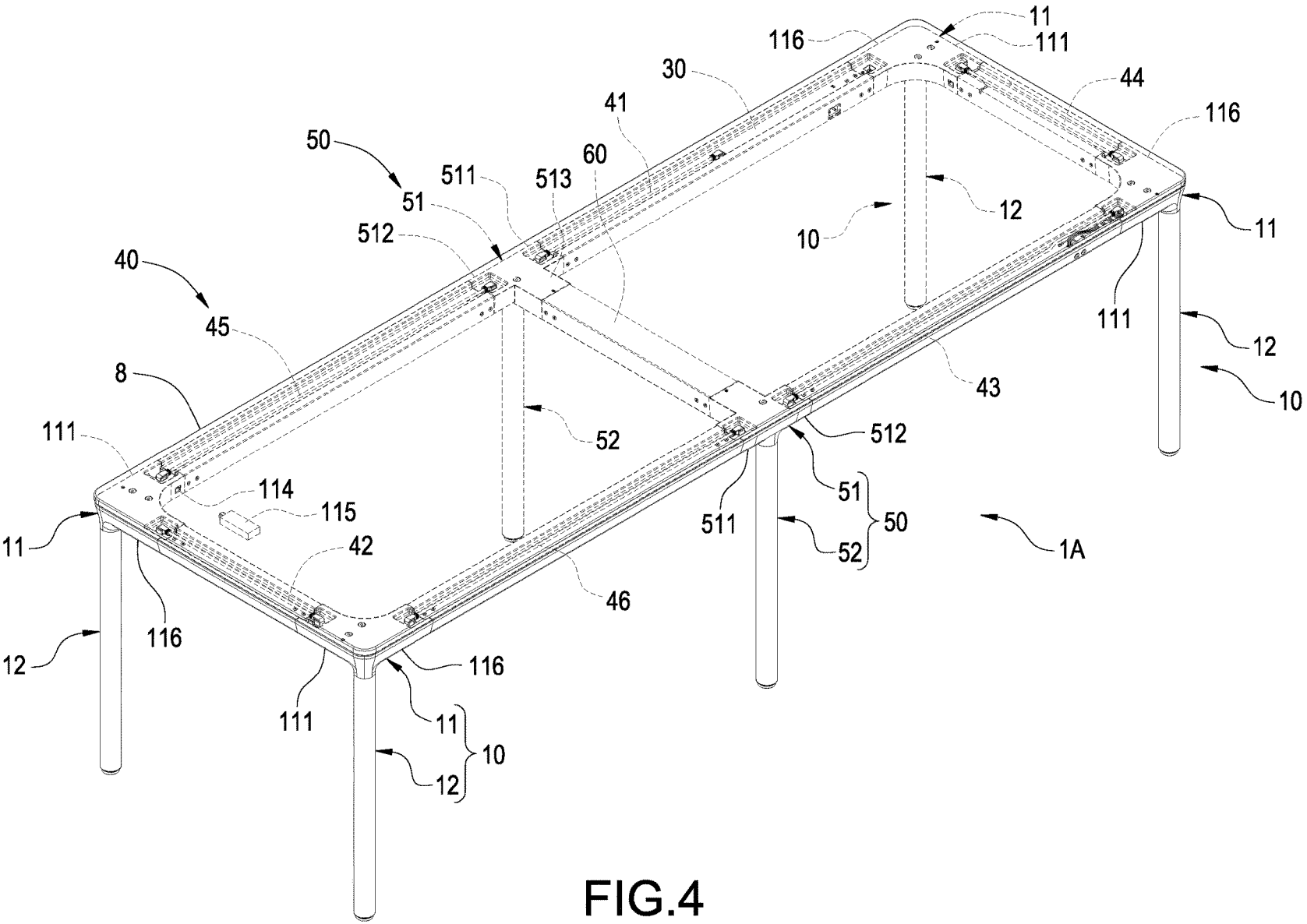
FIG. 4 is a perspective view showing the assembly of the electric desk frame structure being combined with the desk plate according to another embodiment of the present disclosure.

As shown in FIG. 4, the power and signal main cable 40 further has a fifth power and signal cable 45 and a sixth power and signal cable 46. The power and signal main cable 40 is hidden in the cable accommodating recess 23 of each of the connection pipes 20. Two ends of the first power and signal cable 41 are connected to the electricity output port 32 and the first electric connection assembly 5111 of the middle lifting vertical post 50. Two ends of the fifth power and signal cable 45 are connected to the second electric connection assembly 5121 of the middle lifting vertical post 50 and the first electric connection assembly 1133 of the another corner lifting vertical post 10. Two ends of the second power and signal cable 42 are connected to the second electric connection assembly 1183 of the another corner lifting vertical post 10 and the first electric connection assembly 1133 of the one another corner lifting vertical post 10. Two ends of the sixth power and signal cable 46 are connected to the second electric connection assembly 1183 of the one another corner lifting vertical post 10 and the first electric connection assembly 5111 of the another middle lifting vertical post 50. Two ends of the third power and signal cable 43 are connected to the second electric connection assembly 5121 of the another middle lifting vertical post 50 and the first electric connection assembly 1133 of the other corner lifting vertical post 10. Two ends of the fourth power and signal cable 44 are connected to the second electric connection assembly 1183 of the other corner lifting vertical post 10 and the first electric connection assembly 1133 of the corner lifting vertical post 10.

Figure 9:
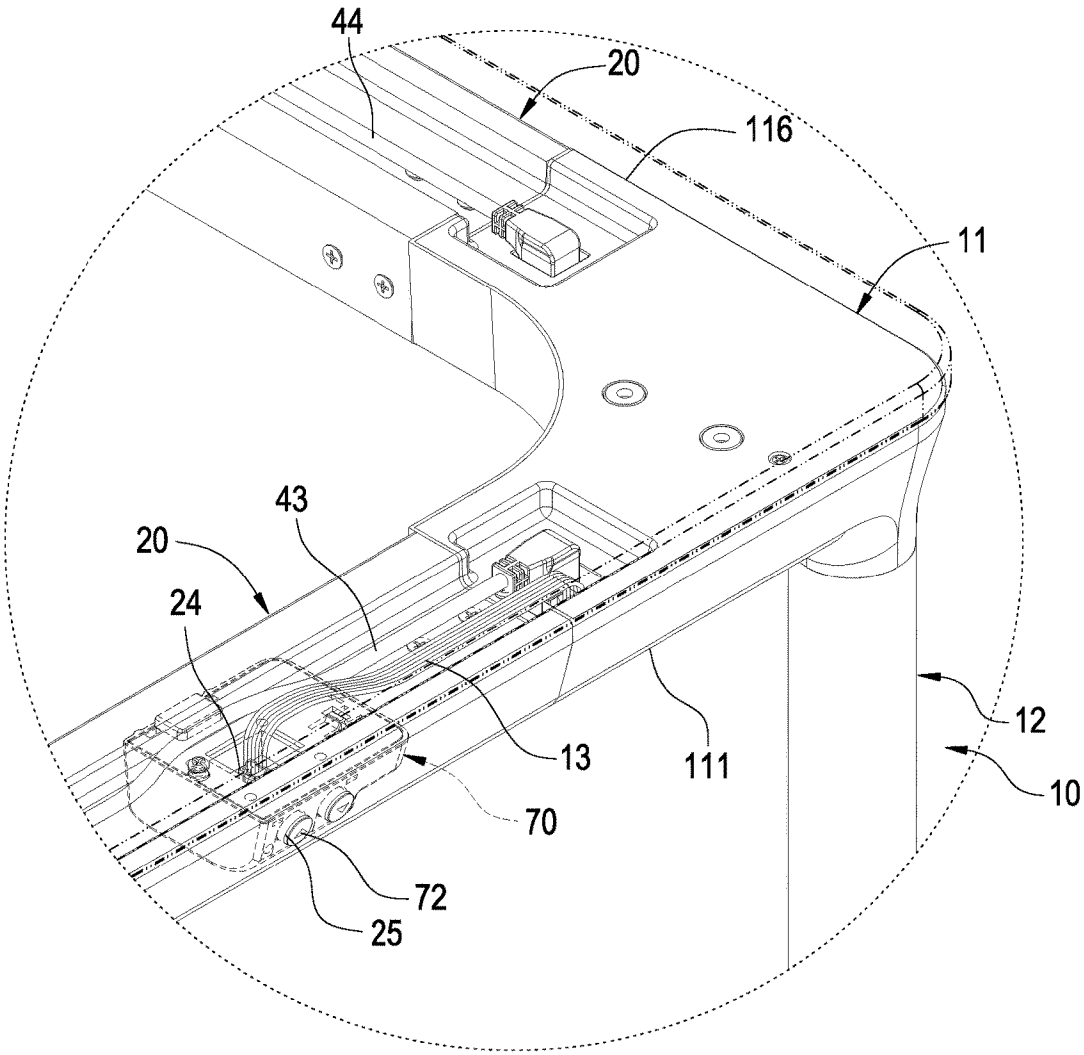
FIG. 9 is a partially enlarged view of zone B of FIG. 7.

As shown in FIG. 9, the electric desk frame structure of the present disclosure further includes a manual controller 70. A first penetrated hole 24 and a plurality of second penetrated holes 25 are formed in one of the connection pipes 20. The manual controller 70 is hidden in the connection pipe 20 having the first penetrated hole 24 and the second penetrated holes 25. The manual controller 70 has a connection port 71 and a plurality of buttons 72. The connection port 71 is arranged corresponding to the first penetrated hole 24. Each of the buttons 72 protrudes from each of the second penetrated holes 25 to be exposed from the connection pipe 20. Two ends of the flat cable 13 are electrically connected to the connection port 71 and the first electric connection assembly 1133. The flat cable 13 is hidden in the cable accommodating recess 23 of the connection pipe 20.

Details are provided as follows. The power and signal main cable 40 is used to connect between each of the corner lifting vertical posts 10 and each of the middle lifting vertical posts 50, and a local interconnect network-bus (LIN-BUS) system is used to establish each node bus. In other words, each of the corner lifting vertical posts 10 and each of the middle lifting vertical posts 50 are served as the node for the bus, thus the user may use the manual controller 70 or the wireless controller to send a signal to make a command to be assigned. When each of the nodes is in an abnormal situation, information may be mutually communicated for adjustments.

Figure 10:
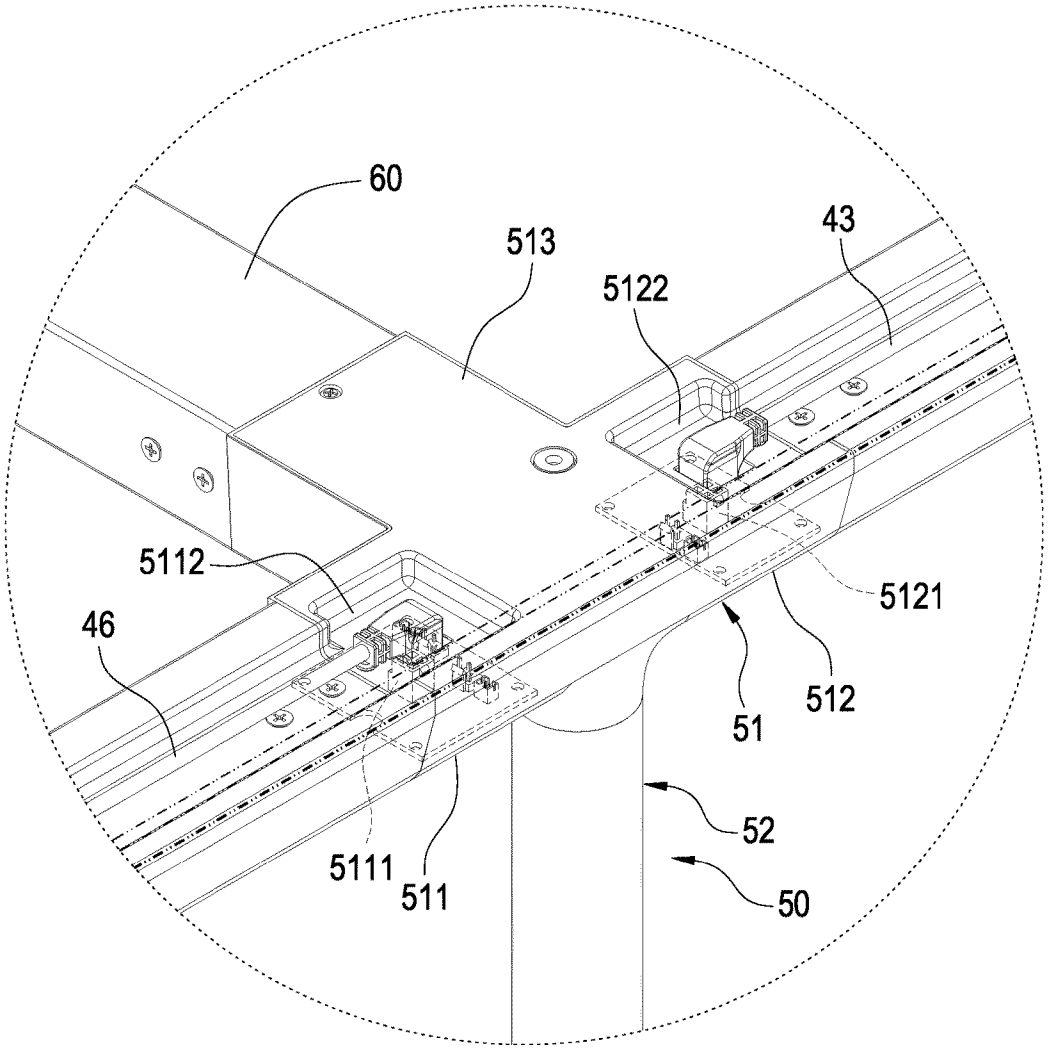
FIG. 10 is a partially enlarged view of zone C of FIG. 7.

Please refer to FIG. 10, the first connection part 511 of each of the middle lifting vertical posts 50 is formed with a bypass recess 5112. The second connection part 512 is also formed with the bypass recess 5122. A plug of the sixth power and signal cable 46 is hidden in the bypass recess 5112. A plug of the third power and signal cable 43 is hidden in the bypass recess 5112. As such, the desk plate 8 is provided with an effect of being flatly placed.

Figure 11:
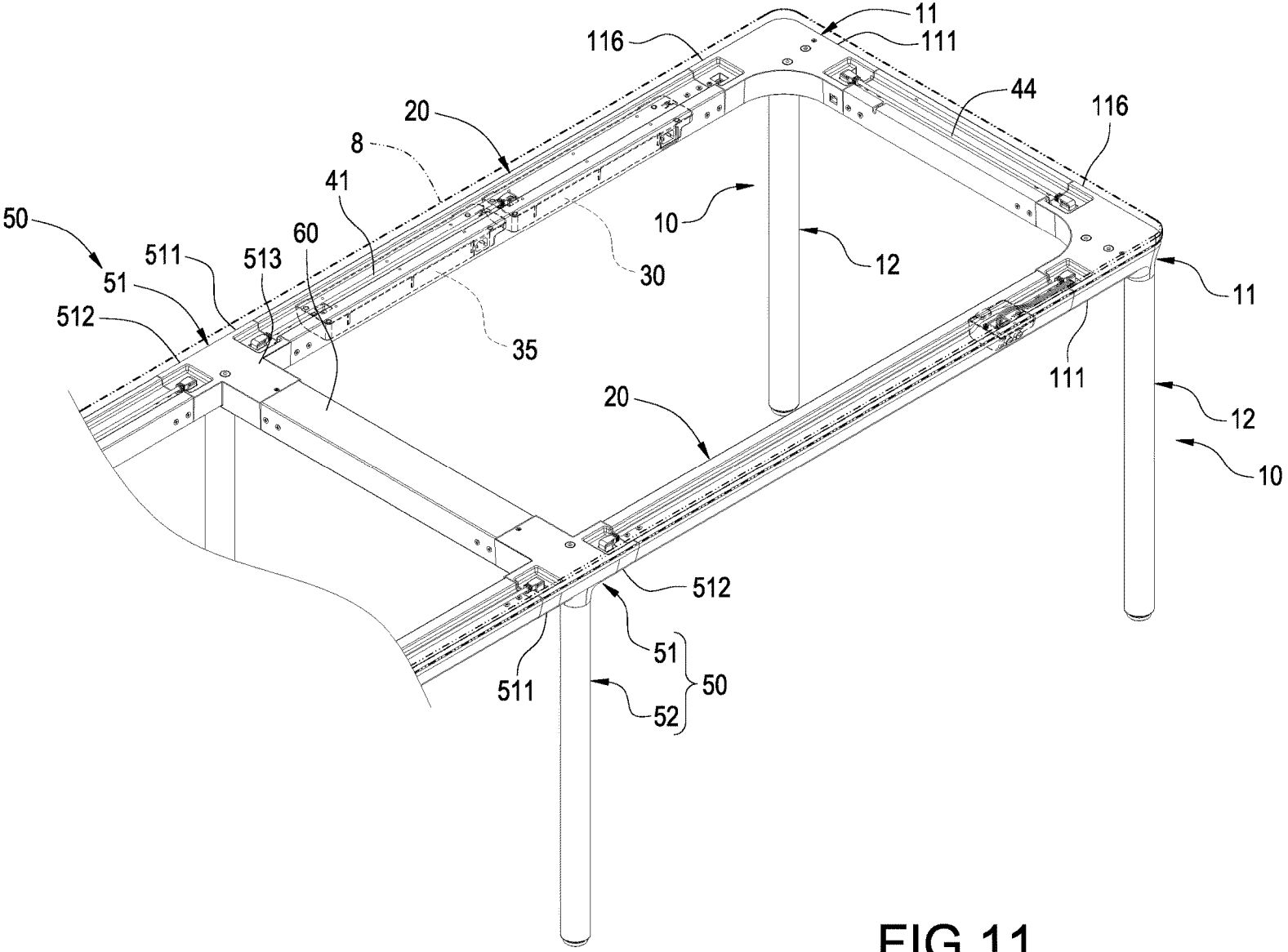
FIG. 11 is a perspective view showing the assembly of the electric desk frame structure being combined with the desk plate according to one another embodiment of the present disclosure.

Please refer to FIG. 11, the electric desk frame structure of the present disclosure further includes another transformer 35. The another transformer 35 is hidden in the connection pipe 20 having the transformer 30 therein. With the electric power outputted by the another transformer 35 and the transformer 30, the electric power requirement of different amounts of the corner lifting vertical posts 10 and the middle lifting vertical posts 50 is provided.

In some embodiments, a power supplier (not shown in figures) may be externally connected. The power supplier is inserted in the first electric connection assembly 1133 or the second electric connection assembly 1183, thus the DC power of the power supplier is provided to each of the corner lifting vertical posts 10 and each of the middle lifting vertical posts 50, or the wireless manner may be provided to the user.

While this disclosure has been described by means of specific embodiments, numerous modifications and variations could be made thereto by those skilled in the art without departing from the scope and spirit of this disclosure set forth in the claims.

What is claimed is:

1. An electric desk frame structure (1, 1A), comprising:

at least four corner lifting vertical posts (10), each two of the corner lifting vertical posts (10) oppositely and spacedly arranged, wherein each of the corner lifting vertical posts (10) comprises a carrying seat (11) and a retractable rod (12) connected to the carrying seat (11), the carrying seat (11) comprises a first connection part (111) and a second connection part (116), the first connection part (111) comprises a first electric connection assembly (1133), and the second connection part (116) comprises a second electric connection assembly (1183) electrically connected to the first electric connection assembly (1133);

at least four connection pipes (20), connected to the corner lifting vertical posts (10) respectively, wherein two ends of each of the connection pipes (20) are connected to the first connection part (111) of one carrying seat (11) and the second connection part (116) of another one carrying seat (11) adjacent to the one carrying seat (11), and one of the connection pipes (20) comprises a first opening (21) and a second opening (22);

a transformer (30), comprising an electricity input port (31) and an electricity output port (32), wherein the transformer (30) is hidden in the connection pipe (20) with the first opening (21) and the second opening (22), the electricity input port (31) is arranged corresponding to the first opening (21), and the electricity output port (32) is arranged corresponding to the second opening (22); and a power and signal main cable (40), connected to the electricity output port (32), the first electric connection assembly (1133) and the second electric connection assembly (1183).

2. The electric desk frame structure (1, 1A) according to claim 1, wherein each of the connection pipes (20) comprises a cable accommodating recess (23) axially defined on a top end thereof, and the power and signal main cable (40) is hidden in the cable accommodating recess (23).

3. The electric desk frame structure (1, 1A) according to claim 2, wherein the first connection part (111) and the second connection part (116) of the carrying seat (11) respectively comprise a bypass recess (1131, 1181), the power and signal main cable (40) comprises a plurality of power and signal cables (41, 42, 43, 44), and two ends of each of the power and signal cables (41, 42, 43, 44) are hidden in two bypass recesses (1131, 1181).

4. The electric desk frame structure (1, 1A) according to claim 1, wherein the first connection part and the second connection part of the carrying seat respectively comprise a bypass recess, the power and signal main cable comprises a plurality of power and signal cables, and two ends of each of the power and signal cables are hidden in two bypass recesses.

5. The electric desk frame structure according to claim 1, further comprising a plurality of middle lifting vertical posts (50), each of the middle lifting vertical posts (50) is disposed between any two of the corner lifting vertical posts (10) adjacent to each other.

6. The electric desk frame structure (1, 1A) according to claim 5, wherein each of the middle lifting vertical posts comprises a first connection part, a second connection part and a third connection part, the first connection part comprises a first electric connection assembly, the second connection part comprises a second electric connection assembly electrically connected to the first electric connection assembly, and the third connection part is arranged perpendicular to the first connection part and the second connection part.

7. The electric desk frame structure according to claim 6, further comprising at least one middle connection member (60), and two ends of the middle connection member (60) connected between two third connection parts (513) of the middle lifting vertical posts (50).

8. The electric desk frame (1, 1A) structure according to claim 4, further comprising another transformer (35), and the another transformer (35) hidden in the one of the connection pipes (20).

9. The electric desk frame structure (1, 1A) according to claim 1, further comprising a manual controller, another one of the connection pipes comprising a first penetrated hole and a plurality of second penetrated holes, the manual controller hidden in the connection pipe with the first penetrated hole and the second penetrated holes, the manual controller comprising a connection port and a plurality of buttons, the connection port arranged corresponding to the first penetrated hole, and each of the buttons protruding from each of the second penetrated holes to be exposed from the connection pipe with the first penetrated hole and the second penetrated holes.

10. The electric desk frame structure according to claim 1, further comprising a wireless receiver (115), the one carrying seat (11) comprising an insertion slot (114) defined on the first connection part (111) and used to allow the wireless receiver (115) to be inserted.

11. The electric desk frame structure (1, 1A) according to claim 1, wherein the first electric connection assembly (1133) comprises a circuit board (1134), a socket (1135) fastened on and electrically connected to the circuit board (1134), and a control unit (1136), and the control unit (1136) comprising a micro controller unit.

12. The electric desk frame structure (1, 1A) according to claim 1, wherein the first connection part comprises a mounting segment (112) and a stopping segment (113) connected to the mounting segment (112), the mounting segment (112) is sheathed by one end of the one of the connection pipes (20), and the stopping segment (113) stops the one end of the one of the connection pipes (20).

13. The electric desk frame structure (1, 1A) according to claim 1, wherein the second connection part (116) comprises a mounting segment (117) and a stopping segment (118) connected to the mounting segment (117), the mounting segment (117) is sheathed by one end of another one of the connection pipes (20), and the stopping segment (18) stops the one end of the another one of the connection pipes (20).

* * * * *